US006994273B2

(12) United States Patent
Ganser et al.

(10) Patent No.: US 6,994,273 B2
(45) Date of Patent: Feb. 7, 2006

(54) FUEL INJECTION VALVE FOR INTERNAL COMBUSTION ENGINES

(75) Inventors: Marco Ganser, Oberägeri (CH); Markus Tappolet, Schaffhausen (CH); Andreas Carelli, Zürich (CH)

(73) Assignee: CRT Common Rail Technologies, AG, Neuhausen am Rheinfall (CH)

( * ) Notice: Subject to any disclaimer, the term of this patent is extended or adjusted under 35 U.S.C. 154(b) by 0 days.

(21) Appl. No.: 10/920,614

(22) Filed: Aug. 18, 2004

(65) Prior Publication Data

US 2005/0072856 A1 Apr. 7, 2005

Related U.S. Application Data

(63) Continuation of application No. PCT/CH03/00025, filed on Jan. 17, 2003.

(30) Foreign Application Priority Data

Feb. 22, 2002 (CH) ..... 0313/02

(51) Int. Cl.
*F02M 41/16* (2006.01)

(52) U.S. Cl. ..... 239/96; 239/88; 239/90; 239/124; 239/533.9; 239/584; 239/585.1; 123/447; 123/472

(58) Field of Classification Search ..... 239/88, 239/90, 96, 124, 127, 533.3, 533.4, 533.9, 239/584, 585.1; 123/445–447, 462, 472, 123/294, 476

See application file for complete search history.

(56) References Cited

U.S. PATENT DOCUMENTS 4,946,103 A * 8/1990 Ganser ..... 239/88
4,976,244 A * 12/1990 Eckert ..... 123/501
5,655,716 A * 8/1997 Mathis ..... 239/533.9
5,732,679 A 3/1998 Takahasi et al.
5,775,301 A 7/1998 Ganser
5,806,766 A 9/1998 Krueger et al.
6,142,443 A * 11/2000 Potschin et al. ..... 239/584

FOREIGN PATENT DOCUMENTS

| | | |
|---|---|---|
| DE | 196 18 468 C1 | 4/1997 |
| EP | 0 909 892 A2 | 4/1999 |
| WO | WO 01/11222 A1 | 2/2001 |
| WO | WO 02/053904 A1 | 7/2002 |

* cited by examiner

*Primary Examiner*—Steven J. Ganey
(74) *Attorney, Agent, or Firm*—Alston & Bird LLP

(57) ABSTRACT

A fuel injection valve for an internal combustion engine which includes an axially moveable needle-like injection valve member 10 mounted in a tubular housing 2. A control element 22 with a control passage 25 is mounted in the upper end portion of the housing, and a valve element 21, 41, 46 is mounted for movement below the control element. A control chamber 20 is formed below the valve element, and a control piston 18 which is formed at the upper end of the valve member 10 bounds the lower side of the control chamber. A throttle passage 26, 42, 47 in the valve element is connected via a throttle constriction between the control passage 25 in the control element 22 and the control chamber 20. A throttle inlet 33, which is formed in the valve element 21 or in a sleeve 19 which laterally bounds the control chamber, is connected between a high pressure chamber 9 in the housing and the control chamber 20 without passage through an intermediate throttle point. The pressure in the control chamber 20 is thus always higher than the pressure in the control passage 25.

24 Claims, 5 Drawing Sheets

FUEL INJECTION VALVE FOR INTERNAL COMBUSTION ENGINES

CROSS REFERENCE TO RELATED APPLICATION

The present application is a continuation of international application PCT/CH03/00025, filed 17 Jan. 2003, and which designates the U.S. The disclosure of the referenced application is incorporated herein by reference.

BACKGROUND OF THE INVENTION

The present invention relates to a fuel injection valve for intermittent fuel injection into the combustion chamber of an internal combustion engine.

A fuel injection valve of this type is described in EP-A-0 426 205 in which a control element which is permanently connected to a housing and which has two end sides which lie opposite one another is arranged in said housing. An adjustable valve element bears, in its closed position, with a seat face against a seat face on the control element, which seat face is provided on an end side of the control element. A control passage which runs in the control element, from its one end side to its other end side is aligned with a throttle passage in the valve element. The throttle passage opens into a control chamber which is bounded by the control element and a control piston of an injection valve element. The control element is provided with a circumferential annular groove which is connected to a high pressure inlet formed in the housing for the fuel. Bores which are formed in the control element lead from the annular groove to the seat face of the control element. The valve element closes off these holes in its closed position. The control passage is connected via a throttle inlet in the control element to the annular groove in which the high pressure of the fuel is present. That end of the control passage which is located in the end side of the control element lying opposite the seat face is kept closed by the stem of a pilot valve.

If the pilot valve is activated, and the corresponding end of the control passage is thus cleared, the pressure in the control passage, in the throttle passage and in the control chamber drops quickly. The injection valve element moves away from its seat and clears injection openings.

The injection process is terminated by the closing of the one end of the control passage by the stem of the pilot valve. Fuel which is under high pressure flows via the throttle inlet in the control element to the control passage and acts on the valve element. The high pressure of the fuel which is present in the bores connected to the annular groove in the control element additionally acts on said valve element. This results in the valve element being briefly moved away from its closed position and clearing the bores in the control element. Fuel which is under high pressure can then flow via these bores into the control chamber. The pressure in the control chamber increases and brings about rapid closing of the injection valve element.

The known fuel injection valve has, inter alia, the disadvantage that it is costly to manufacture the control element.

The present invention is based on the object of providing a fuel injection valve of the described type which operates reliably while being simple to manufacture, and closes in each case with the smallest possible delay, and requires the smallest possible amount of fuel to control the opening and closing movement of the injection valve element.

SUMMARY OF THE INVENTION

The above and other objects and advantages of the invention are achieved by a fuel injection valve which includes a control element mounted within an upper end of a tubular housing and which has an axial control passage, and an adjustable valve element mounted adjacent the lower end side of the control element. The valve element includes a throttle passage by which the control passage is able to communicate with a control chamber in the housing. A throttle inlet is positioned so as to be connected between a high pressure chamber in the housing and the control chamber, with the throttle inlet having an outlet which either directly communicates with the control chamber or opens into the throttle passage at a location between a constriction in the throttle passage and the control chamber.

Since the control chamber is thus directly connected via the throttle inlet to the high pressure chamber in which the fuel system pressure is present, without passing through an intermediate throttle point, the static pressure in the control chamber is higher than in the known fuel injection valve which is described above. The result of this is that the delay time between the closing of the one end of the control passage by the pilot valve and the closing of the injection openings by the injection valve element is shortened and in addition uncontrolled adjustment of the valve element is prevented. In addition, the quantity of fuel which flows into the control chamber through the throttle inlet during an injection process can be kept small. As a result, the loss of energy resulting from a pressure reduction in the control chamber can be minimized whenever the control passage is cleared.

Owing to the smaller number of passages and bores, the control element is easier to manufacture than in the case of the above mentioned, known fuel injection valve.

BRIEF DESCRIPTION OF THE DRAWINGS

Exemplary embodiments of the subject matter of the invention are explained in more detail below with reference to the drawings, in which, in purely schematic form.

DETAILED DESCRIPTION OF THE PREFERRED EMBODIMENTS

Figure 1:
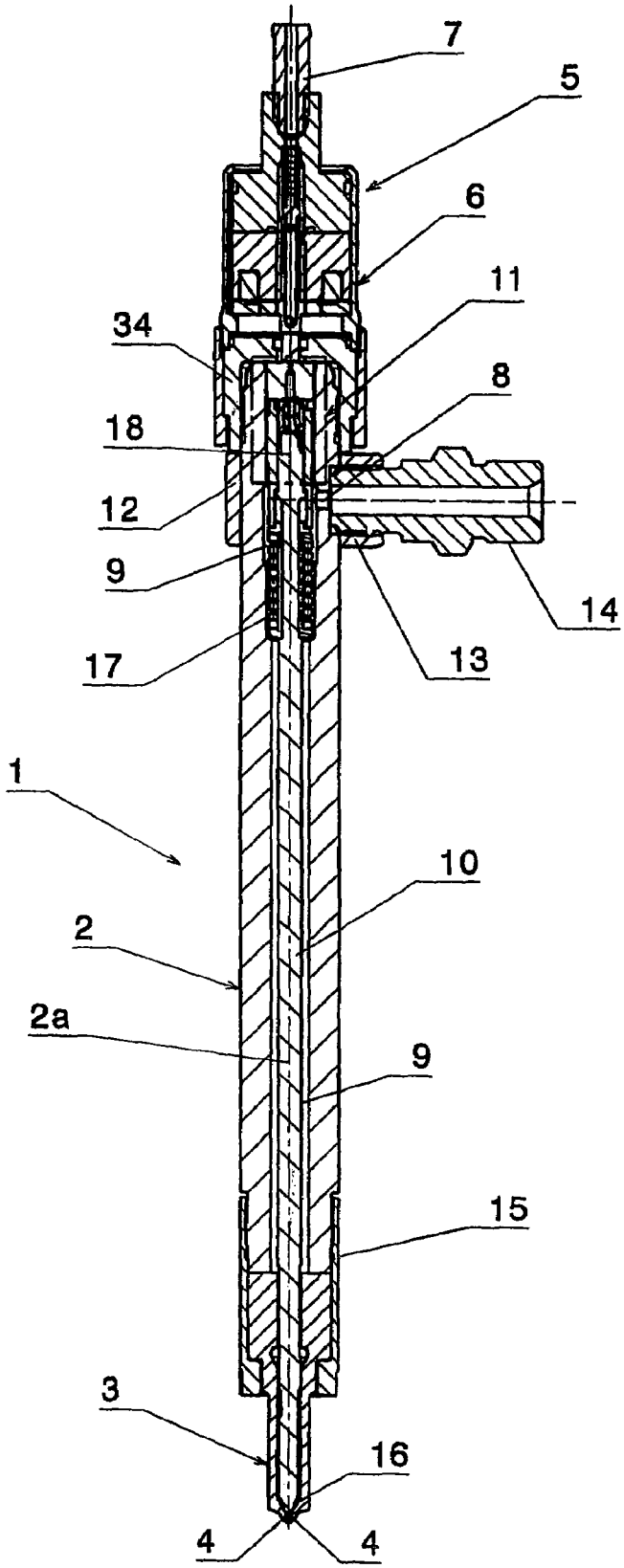
FIG. 1 shows a fuel injection valve in a longitudinal section and which embodies the invention.

FIG. 1 shows an axial section through a first embodiment of a fuel injection valve 1 according to the invention. The latter has a tubular, elongate housing 2 whose longitudinal axis is designated by 2*a*. A valve seat element 3 with injection openings 4 is attached to the housing 2 at one end, and a pilot valve 5 which can be activated electromagnetically is attached to the other end. The pilot valve 5, which is of a configuration which is known per se, has an electromagnet 6. The fuel injection valve 1 is also provided with a low pressure outlet connector 7 to which a return line (not shown), which feeds fuel into a fuel reservoir (also not shown), is connected.

The housing 2 is provided with a bore which serves as a high pressure inlet 8 and extends in the radial direction and through which fuel is introduced, at a high pressure (200 to 2000 bar or more), into a high pressure chamber 9 which is formed in the interior of the housing 2. The high pressure chamber 9 extends in the axial direction as far as the end of the housing 2 at the valve seat element side, and towards the region of the injection openings 4. In this high pressure chamber 9 there is an injection valve element 10 which is formed in the manner of a needle and whose axis coincides with the axis 2*a* of the tubular housing 2. In the interior of the latter there is also a hydraulic control device 11 for the injection valve element 10, which is described in more detail below in conmouth with FIG. 2.

The housing 2 engages through a connecting collar 12 with a threaded flange 13 which protrudes in the radial direction and into which a high pressure connector element 14 is threaded. This high pressure connector element 14 is fluidly connected to the high pressure inlet 8 in the housing 2. The connecting collar 12 is attached to the housing 2 by means of the high pressure connector element 14 in a way which is not illustrated in more detail.

The valve seat element 3 is attached to the housing 2 by means of a union nut 15 and has a valve seat 16 which interacts with the end region of the injection valve element 10 which is shaped in a diametrically opposed fashion. The injection valve element 10 is prestressed in the closing direction by means of a closing spring 17 which is formed as a compression spring. When the injection valve element 10 is in closed position, the injection openings 4 are closed, i.e. disconnected from the high pressure chamber 9. In the injection position, the injection valve 10 is lifted off from the valve seat 16 and clears the connection between the high pressure chamber 9 and the injection openings 4.

Figure 2:
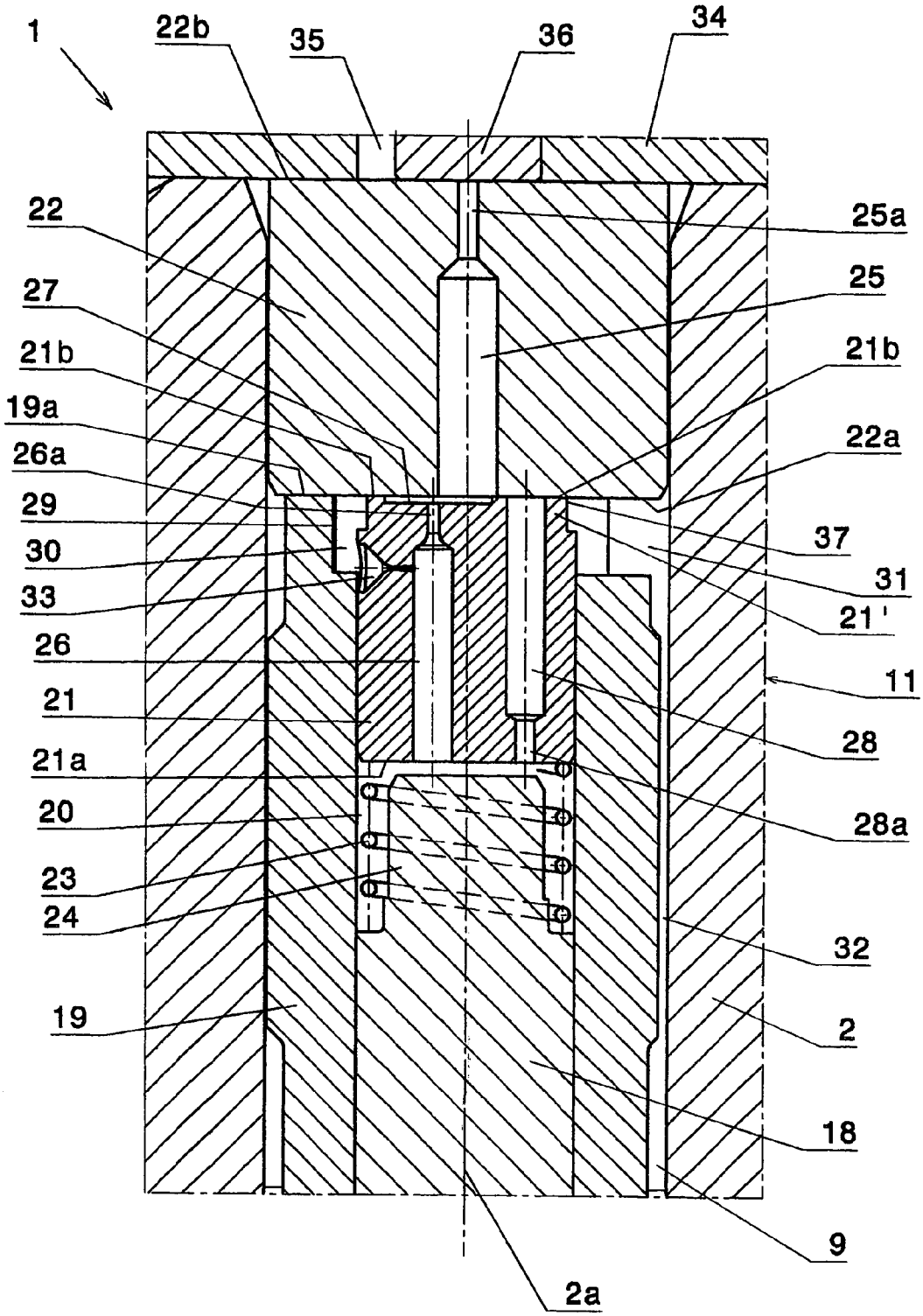
FIG. 2 shows, also in longitudinal section and on an enlarged scale in comparison with FIG. 1, the region of the control device of the fuel injection valve according to FIG. 1.

The control device 11 will now be described with reference to FIG. 2. As FIG. 2 shows, the injection valve element 10 has, in its end region facing away from the valve seat element 3, a double-acting control piston 18 which is guided with a very close sliding fit, i.e. with very little play, in a sleeve 19 which is arranged in the interior of the housing 2. The high pressure of the fuel which is present in the high pressure chamber 9 is applied to the control piston 18 on one side (see FIG. 1) and bounds, on the opposite side, a control chamber 20 which is bounded at the circumference by the sleeve 19. In addition, a valve element which is embodied as a slider valve element 21 is arranged in a close sliding fit in the sleeve 19 and is guided in a freely movable fashion in the direction of the axis 2*a* of the housing. A first end side 21*a*, facing the control piston 18 of the injection valve element 10, of the slider valve element 21 also bounds the control chamber 20. A second end side 21*b*, facing away from the first end side 21*a*, of the slider valve element 21 is embodied as a sealing face and has the purpose of bearing in a seal-forming fashion, in a closed position of the slider valve element 21, against a lower end side 22*a* of a control element 22 which is embodied as a slider valve seat. The control element 22 is permanently fixed in the housing 2, for example by means of a form fit.

A spring element 23 which is embodied as a compression spring and which is supported, on the one hand, on the control piston 18 and, on the other hand on the slider valve element 21 is arranged in the control chamber 20. The spring element 23 engages around a central projection 24 of the control piston 18. The force which is generated by the spring element 23 is significantly less than that of the closing spring 17. A control passage 25 which extends coaxially with respect to the axis 2*a* of the housing and which has a throttle constriction 25*a* in an end region facing away from the slider valve element 21 is formed in the control element 22.

A throttle passage 26 with a throttle constriction 26*a* which is positioned toward the second end side 21*b* and forms a throttle point extends from the first end side 21*a* to the second end side 21*b* in the slider valve element 21, eccentrically with respect to the longitudinal axis 2*a* of the housing. A channel 27, which extends from the mouth of the throttle passage 26 towards the longitudinal axis 2*a* of the housing in the radial direction and proceeds beyond it is formed in the second end side 21*b* of the slider valve element 21. The channel 27 connects the control passage 25 to the throttle passage 26 when the slider valve element 21 bears against the control element 22 in a seal-forming fashion.

The slider valve element 21 is also provided with a further throttle passage 28 with a throttle constriction 28*a* which extends between the first and the second end sides 21*a*, 21*b* of the slider valve element 21 and whose end which faces away from the control chamber 20 is closed by the lower end face 22*a* on the control element 22 when the slider valve element 21 is in the closed position. When the slider valve element 21 is lifted off from the control element 22, the further throttle passage 28 connects the control chamber 20 to the high pressure chamber 9, in a connection which is parallel to the first throttle passage 26.

In its end region facing the control element 22, the sleeve 19, which is supported by an end face 19*a* on the control element 22, has, on the inner side, a circumferential recess 29 which forms, with the slider valve element 21, an annular chamber 30 when said slider valve element 21 is in the closed position. Said annular chamber 30 is connected to the high pressure chamber 9 via a slit 31 in the sleeve 19, and via at least one flow gap 32 which extends in the axial direction and has a large cross section which is formed between the inner wall of the housing 2 and a flattened portion on the outside of the sleeve 19. When the slider valve element 21 is moved away from the control element 22, a gap, which is connected to the high pressure chamber 9, is formed between said slider valve body 21 and control element 22, meaning that the entire second end side 21*b* of the slider valve element 21 has high pressure applied to it.

In the slider control 21, a throttle inlet 33 is formed which connects the annular chamber 30 to the throttle passage 26. The throttle passage 33 widens towards the annular chamber 30 and opens into the throttle passage 26, between the throttle constriction 26*a* and the first end side 21*a* of the slider valve element 21. The control chamber side mouth of the throttle inlet 33 thus lies on the side facing the control chamber 20 with respect to the throttle constriction 26*a*. The control chamber 20 is thus connected to the high pressure chamber 9 via the throttle inlet 33, the annular chamber 30, the slit 31 and the flow gap 32. It is ensured by structural means that the pressure in the flow gap 32, in the slit 31 and in the annular chamber 30 is essentially the same as that in the high pressure inlet 8 and in the high pressure chamber 9.

As is apparent from FIG. 1, a union nut 34, which is illustrated only partially in FIG. 2 and which has a through bore 35 in the center is screwed onto the tubular housing 2 from the pilot valve 5 side. The through bore 35 is associated with a low pressure chamber and is fluidically connected to the low pressure outlet connector 7. A pilot valve stem 36 which is associated with the pilot valve 5 is arranged in this through bore 35 so as to be displaceable in the axial direction, and is guided radially. When the electromagnet 6 of the pilot valve 5 is not excited, the pilot valve stem 36 is held abutting against the control element 22, and closes the mouth of the throttle constriction 25*a* of the control passage 25. The union nut 34 holds the control element 22 firmly counter to the pressure in the high pressure chamber 9, said control element 22 being possibly only gently pressed into the housing 2, and positions the control element 22 precisely.

The slider valve element 21 is stepped at its end facing the control element 22, i.e. its cylindrical end part 21' which faces the control element 22 has a smaller external diameter than the rest of the slider valve element 21. This step formation is brought about by means of a recess 37 which extends along the circumference of the slider valve element 21. The magnitude of the area of the upper, second end face 21*b* of the slider valve element 21 can be determined by the depth of this recess 37, i.e. its dimension in the radial direction. The recess 37 can be manufactured comparatively easily and precisely because only one cylindrical face has to be processed.

The method of operation of the fuel injection valve which is shown in FIGS. 1 and 2 will now be explained below with reference to FIG. 3, which shows the variation over time of the pressure p in the control chamber 20 (curve I) and in the control passage 25, i.e. in the discharge chamber (curve II).

The state (shown in FIGS. 1 and 2) in which the injection valve 10 and the slider valve element 21 are in the closed position and the slider valve element 21 thus bears against the control element 22 is taken as the starting point. The pilot valve stem 36 closes the control passage 25. The same pressure is present in the control chamber 20 as in the high pressure chamber 9.

An injection cycle is initiated by exciting the electromagnet 6 of the pilot valve 5. The pilot valve stem 36 lifts off from the valve element 22, as a result of which the control passage 25 is connected to the through bore 35, and thus to the low pressure chamber (time t1, FIG. 3). The pressure in the discharge chamber drops (section a of curve II, FIG. 3). Since the throttle constriction 25*a* in the control passage 25 has a larger flow cross section than the throttle inlet 33, the pressure in the control chamber 20 begins to drop (section a of curve I, FIG. 3). The injection valve element 10 thus moves away from the valve seat 16 and clears the injection openings 4 (time t2, FIG. 3). The injection process starts. The control piston 18 moves upward with the injection valve element 10, leading to a reduction in the control volume of the control chamber 20 and to an increase in pressure in the control chamber 20 (section b of curve I, FIG. 3). Fuel is expelled from the control chamber 20 into the low pressure chamber through the throttle passage 26, the depression 27 and the control passage 25. The opening movement of the injection valve element 10 is terminated at the time t3 (FIG. 3).

During the entire opening process of the injection valve element 10, the slider valve element 21 remains in abutment against the control element 22. The further throttle passage 28 in the slider valve element 21 thus remains closed and does not have any effect for the time being. The opening stroke of the injection valve element 10 is limited by the fact that its projection 24 comes to bear against the slider valve element 21, the throttle passage 26 remaining cleared. The opening stroke of the injection valve element 10 can also be limited in a different way, which is not illustrated in more detail. Since the smallest flow cross section of the throttle constriction 26*a* of the throttle passage 26 is smaller than the cross section of the throttle constriction 25*a*, the opening movement of the injection valve element 10 is determined mainly by the throttle passage 26 for a given system pressure and given closing spring 17. Starting from the aforementioned time t3, the pressure in the control chamber 20 drops, said control chamber 20 being of course connected to the low pressure chamber (section c of curve I, FIG. 3) via the throttle passage 26 and the control passage 25.

In order to terminate the injection process, the electromagnet 6 is de-excited. This results in the pilot valve stem 36 being displaced so as to abut against the control element 22. As a result, the low pressure end mouth of the control passage 25 is closed (time t4, FIG. 3). The pressure in the control chamber 20 and in the control passage 25 begins to rise as a result of the connection to the high pressure chamber 9 via the throttle inlet 33 and the throttle passage 26 (section d of curve I and b of curve II, FIG. 3), resulting, owing to the now decreasing pressure difference on both sides 21*a*, 21*b* of the slider valve element 21 and the corresponding effective areas, in the slider valve element 21 moving away from the seal-forming abutment against the control element 22, accompanied by the formation of a gap. At the same time, the closing spring 17 causes the injection valve element 10 to move in the direction of the valve seat 16. The pressures in the control passage 25 and in the control chamber 20 approximate one another. The injection process is terminated.

The slider valve element 21 then moves back into the closed position, supported by the force of the spring element 23. This backward movement of the slider valve element 21 into the closed position is accelerated by the fact that when the slider valve element 21 lifts off from the control element 22, the further, relatively large throttle passage 28 is cleared and as a result a further connection is brought about between the control chamber 20 and the high pressure chamber 9. This leads to a rapid backward movement of the slider valve element 21 into the closed position. The fuel injection valve 1 is thus ready more quickly for the next injection process, which is of great advantage, for example, in the case of pre-injection, post-injection or multiple injections. As a result of the dimensioning of the further throttle passage 28, the backward movement of the slider valve element 21 can be set in accordance with the requirements.

A second embodiment of the control device 11 will now be described with reference to FIG. 4. Moreover, the fuel injection valve 1 is of identical design, as is shown by FIGS. 1 and 2. For identical and identically acting parts, the same reference symbols are used in FIG. 4 as in FIGS. 1 and 2.

Figure 4:
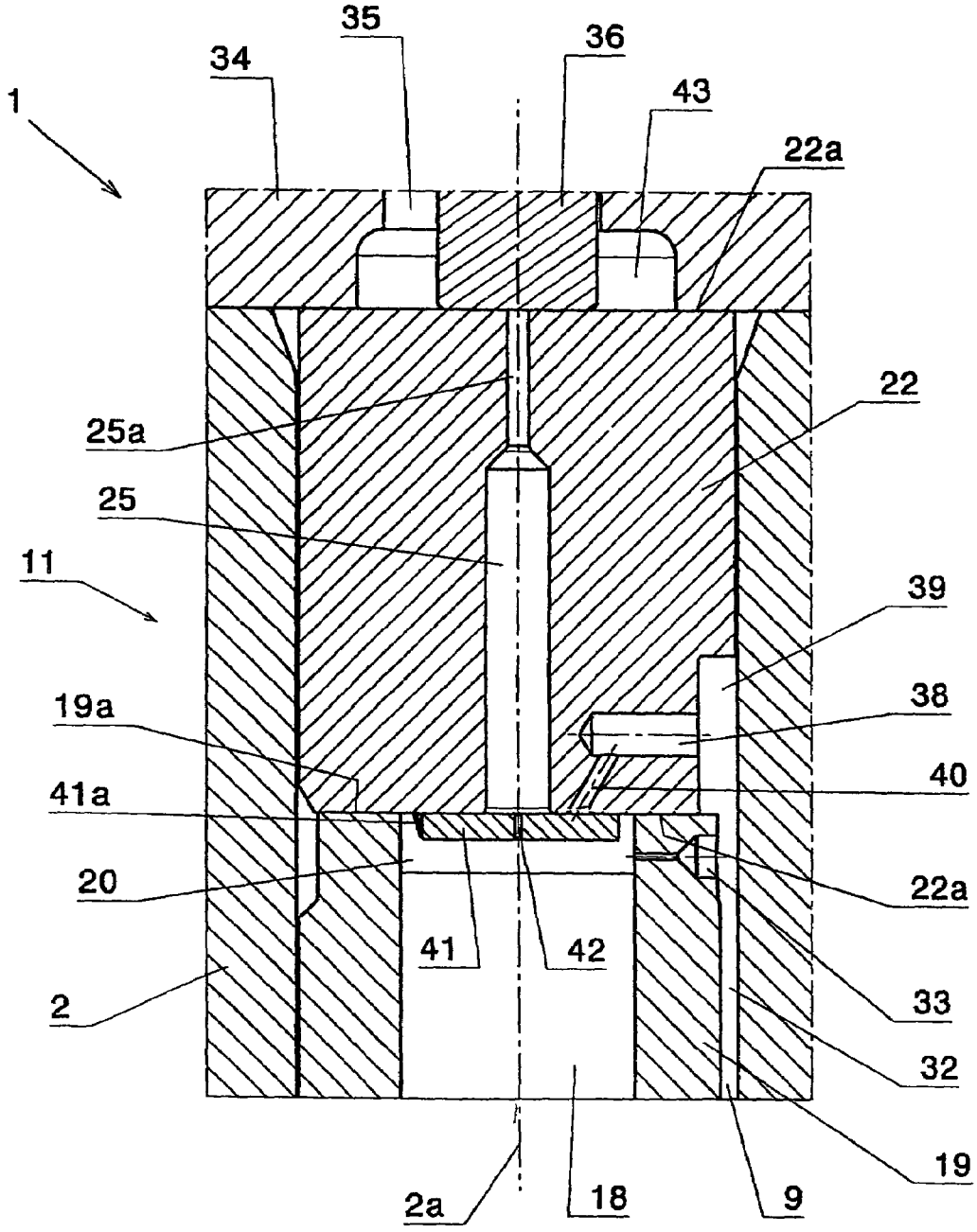
FIG. 4 shows a second embodiment of the control device of the invention in an illustration corresponding to FIG. 2.

The embodiment which is shown in FIG. 4 also has a tubular housing 2 in which the control element 22 is arranged in a firmly seated fashion. The sleeve 19, in which the double-acting control piston 18 of the injection valve element 10 is arranged with a tight fit and so as to be moveable in the axial direction, is supported, by its end side 19*a* facing the control chamber 20, on the control element 22 in a seal-forming fashion. The control chamber 20 is thus bounded at one end by the control piston 18, around the circumference by the sleeve 19 and at the other end by the control element 22. The throttle inlet 33, which is formed in the sleeve 19 and is connected to the high pressure chamber 9 via the flow gap 32 lying between the sleeve 19 and the housing 2, opens into this control chamber 20. The control chamber 20 is thus directly connected to the high pressure chamber 9 via the throttle inlet 33 which tapers towards the control chamber 20.

The control element 22 has the control passage 25 which extends centrally and in the direction of the axis 2*a* of the housing. In the control element 22 there is a bore 38 which extends in the radial direction and is connected to the high pressure chamber 9 via a recess 39 in the control element 22 and the flow gap 32. A further bore 40, which opens into the bore 39, extends through the control element 22, from its end side 22*a* facing the control chamber 20.

Both the control chamber end mouth of the control passage 25 and that of the further bore 40, which both lie in the lower end side 22*a* of the control element 22, are covered by means of a leaf spring-like tongue 41 which serves as a valve element. At the end 41*a* lying opposite the further bore 40 with respect to the axis 2*a* of the housing, the tongue 41 is welded onto the control element 22 in a manner which is not illustrated in more detail. The tongue 41 has a throttle passage 42 which is coaxial with respect to the axis 2*a* of the housing, forms a throttle point and connects the control chamber 20 to the control passage 25. With respect to this throttle passage 42, the control chamber side mouth of the throttle inlet 33 lies on the side facing the control chamber 20. The throttle constriction 25*a* in the control passage 25 is larger in cross section than the cross section of the throttle passage 42 and of the throttle inlet 33.

In all other respects, the fuel injection valve 1 is of identical design to that shown in FIGS. 1 and 2.

For the following description of the method of operation of the fuel injection valve 1 with a control device 11 according to FIG. 4, the position of rest in which the injection valve element 10 is in the closed position and the pressure in the control chamber 20 corresponds to the pressure in the high pressure chamber 9 is used as the starting point, as with respect to the embodiment according to FIGS. 1 and 2. The pilot valve stem 36 closes the mouth of the throttle constriction 25*a* of the control passage 25.

When the electromagnet 6 is excited (see FIG. 1), the pilot valve stem 36 is lifted off from the control element 22. The control passage 25 is thus connected to a recess 43 which is associated with the low pressure chamber, is formed in the union nut 34 and is connected to the through bore 35. The pressure in the control passage 25 drops, as a result of which fuel flows through the throttle passage 42 from the control chamber 20 and into the control passage 25 and from there on into the low pressure chamber, as a result of the pressure difference. The pressure in the control chamber 20 drops and the injection valve element 10 moves away from the valve seat 16, as a result of which the injection process starts. The tongue 41 is held abutting against the lower end side 22*a* of the control element 22 and keeps the further bore 40 closed during the injection process.

When the electromagnet 5 is de-excited, the pilot valve stem 36 bears again against the control element 22, as a result of which the control passage 25 is disconnected from the low pressure chamber. The high pressure of the fuel which is present in the high pressure chamber 9 and which causes the tongue 41 to bend and clear the bore 40 acts, via the holes 38 and 40, on the side of the tongue 41 which faces away from the control chamber 20. Owing to the bore 40 being cleared, fuel then passes into the control chamber 20 via a larger flow cross section than that of the throttle inlet 33, leading to a rapid increase in pressure in the control chamber 20 and to an acceleration of the movement of the injection valve element 10 onto the valve seat 16. As a result of the dimensioning of the corresponding passages and of the properties of the tongue 41, the operating behavior of the fuel injection valve 1 can be configured in accordance with the requirements.

A third embodiment of the control device 11 will be described with reference to FIG. 5. Moreover, the fuel injection valve 1 is identical to the design shown in FIGS. 1 and 2. The same reference symbols as in FIGS. 1 and 2 are used for FIG. 5 for identical and identically acting parts.

Figure 5:
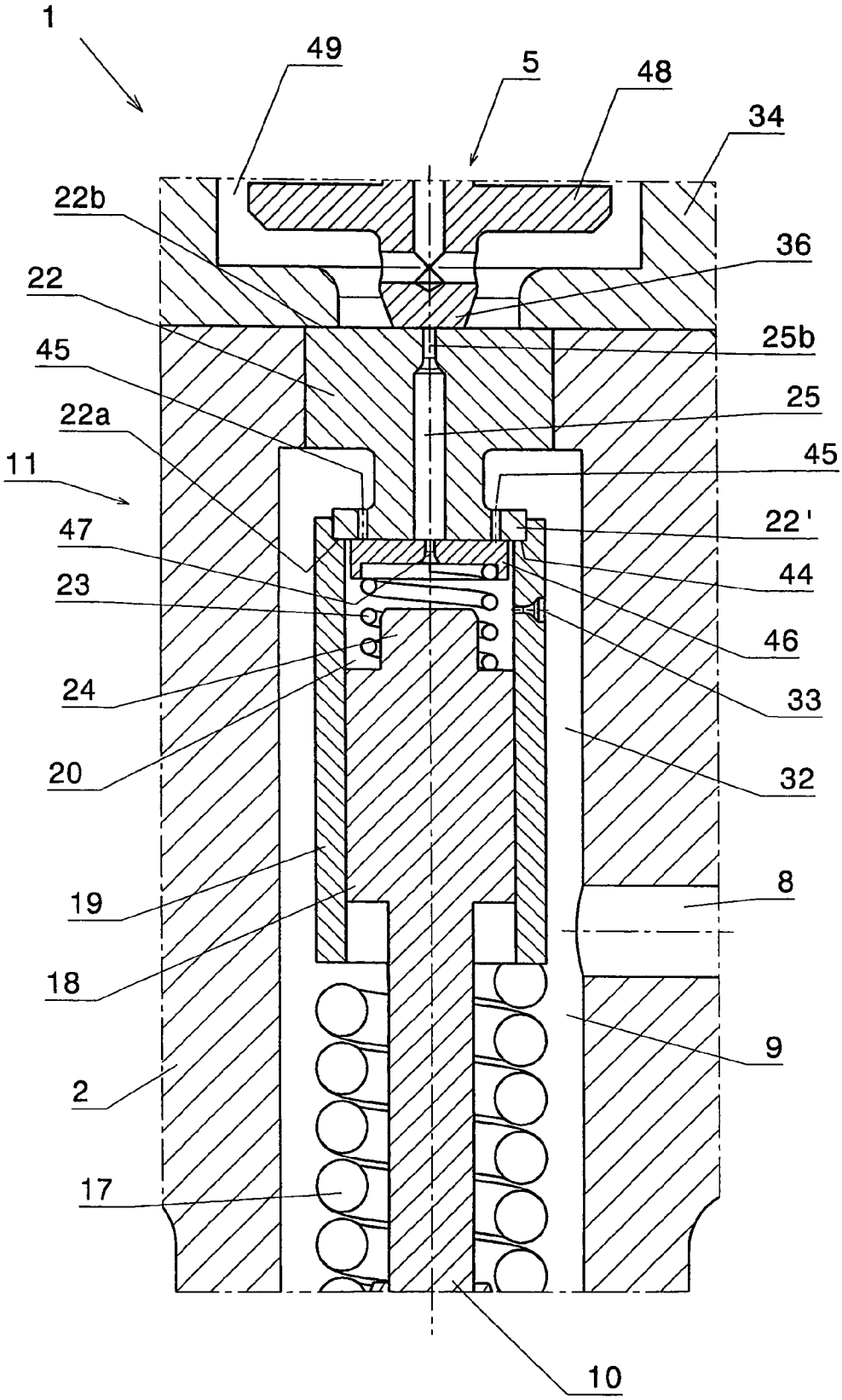
FIG. 5 shows a third embodiment of the control device of the invention in an illustration corresponding to FIG. 2.

The embodiment shown in FIG. 5 also has a tubular housing 2 in which the control element 22 is arranged fixed to the housing. At its end facing the control element 22, the sleeve 19, in which the double-acting control piston 18 of the injection valve element 10 is arranged with a tight fit so as to be moveable in the axial direction, is supported on the control element 22. For this purpose, the sleeve 18 is provided with an annular shoulder 44, in which a guide part 22', guiding the sleeve 19, of the control element 22 engages. It is also conceivable to guide the sleeve 19 by means of a guide which is arranged in the flow gap 32 and is provided with passages. In this case, the annular shoulder 44 is dispensed with. The closing spring 17 for the injection valve element 10 is supported on the sleeve 19, on its side facing away from the control element 22. The control chamber 20 is thus bounded at one end by the control piston 18, at the circumference by the sleeve 19, and at the other end by the control element 22.

The control element 22 has a control passage 25 extending centrally and in the direction of the axis 2*a* of the housing. In the guide part 22' of the control element 22 there are through holes 45 whose axes extend parallel to the axis 2*a* of the housing and which are fluidically connected to the high pressure chamber 9 via the flow gap 32 which surrounds the sleeve 19 in an annular shape.

The control chamber end mouths of the passage holes 45 are covered by means of a cylindrical valve element 46 which is in the form of a plate which bears against the lower end side 22*a* of the control element 22 and is supported on the spring element 23, which is itself supported on the control piston 18. The valve element 46 has a throttle passage 47 which is coaxial with respect to the axis 2*a* of the housing and which forms a throttle point and connects the control chamber 20 to the control passage 25. With respect to this throttle passage 47, the control chamber end mouth of the throttle inlet 33 lies on the side facing the control chamber 20. The throttle constriction 25*a* of the control passage 25 is larger in cross section than the cross section of the throttle passage 47. Not only the pilot valve stem 36 of the pilot valve 5 is shown but also the armature 48, which is connected to the latter, of the electromagnet 6, which is arranged in a recess 49 in the union nut 34. This recess 49 is associated with the low pressure chamber. Moreover, the fuel injection valve 1 has the same design as shown in FIGS. 1 and 2.

For the following description of the method of operation of the fuel injection valve 10 with a control device 11 according to FIG. 5, the state of rest in which the injection valve element 10 is in the closed position and the pressure in the control chamber 20 corresponds to the pressure in the high pressure chamber 9 is also used as the starting point. The mouth of the throttle constriction 25*a* of the control passage 25 is closed as a result of the pilot valve stem 36 bearing against the control element 22.

When the electromagnet 5 is excited, the pilot valve stem 36 is lifted off from the control element 22. The control passage 25 is thus connected to the low pressure chamber. Fuel flows through the throttle passage 47 out of the control chamber 20 into the control passage 25 and onto the low pressure chamber. The pressure in the control chamber 20 drops and the injection valve element 10 is moved away from the valve seat 16, as a result of which the injection process starts. During this injection process, the through holes 45 in the control element 22 remain closed by the valve element 46 which is in the closed position.

When the electromagnet 5 is de-excited, the pilot valve stem 36 bears again against the control element 22, as a result of which the control passage 25 is closed and thus disconnected from the low pressure chamber. The high pressure of the fuel which is present in the high pressure chamber and which leads to the valve element 46 temporarily lifting off from the lower end side 22*a* of the control element 22 acts on the side of the valve element 46 which faces away from the control chamber 20. The through holes 45 are cleared and fuel passes under system pressure into the control chamber 20 via a relatively large flow cross section, leading to a rapid increase in pressure in the control chamber 20 and to an accelerated movement of the injection valve element 10 onto the valve seat 16. A rapid closing movement of the injection valve element 10 is thus brought about.

Figure 3:
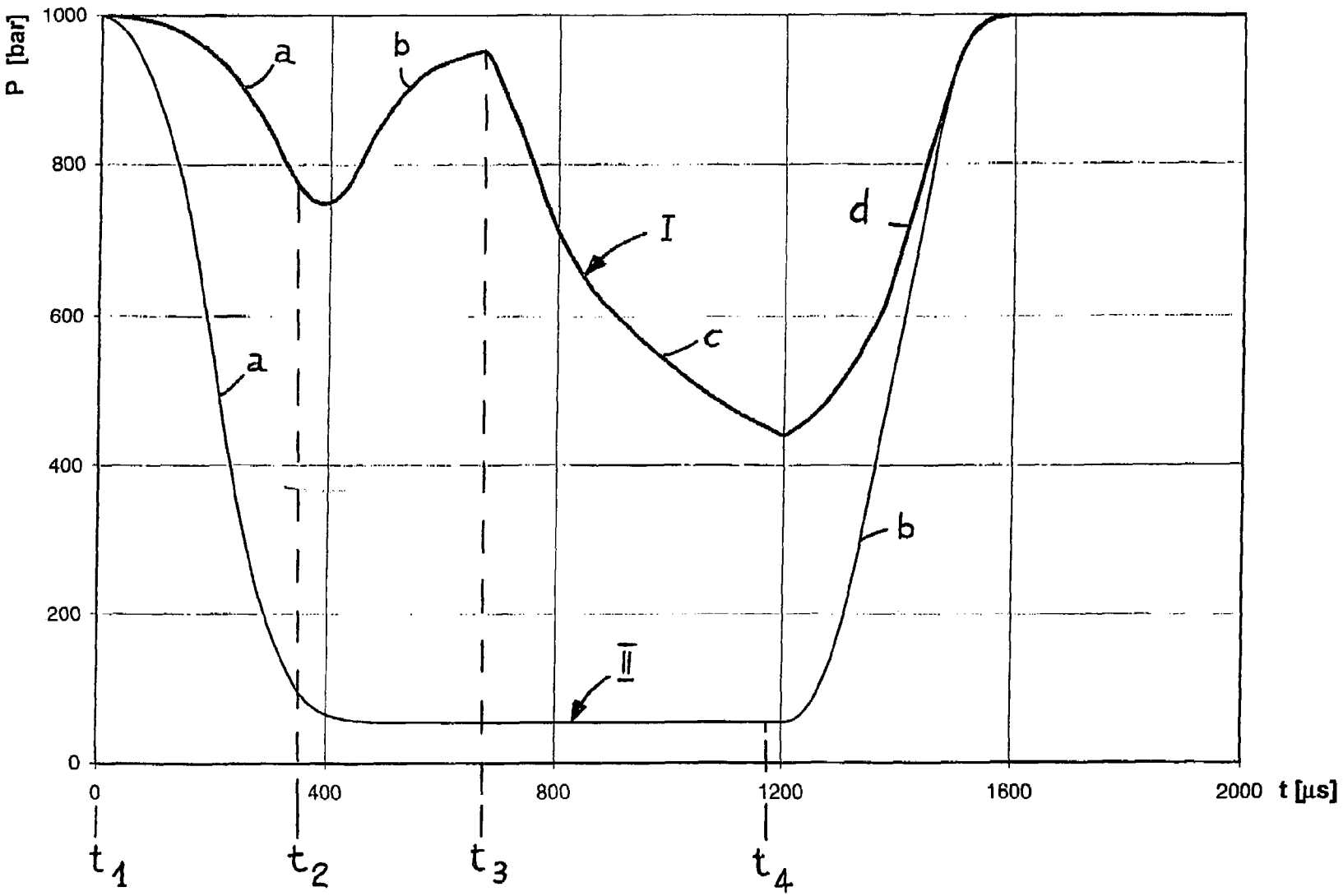
FIG. 3 shows a diagram of the pressure profile at two different locations in the control device according to FIG. 2.

As a result of the fact that in all the exemplary embodiments shown the control chamber 20 is connected directly, i.e. without passing through an intermediate further throttle point, to the high pressure chamber 9, and to the control passage 25 in the control element 22 via a throttle passage 26, 42, 47 which defines a throttle point, the pressure p in the control passage 20 is always significantly higher than the remaining pressure in the control passage 25, as is shown by a comparison of curves I and II in FIG. 3. The result of this is that undesired, uncontrolled lifting off of the valve element, i.e. of the slider valve element 21, of the tongue 41 or of the valve element 46, from its position abutting against the control element 22 is prevented. In addition, the quantity of fuel which flows off to the low pressure chamber via the control passage 25 during each injection process is kept small, leading to lower losses. The increased control pressure in the control chamber 2 also leads to a shortening of the delay time between the closing of the control passage 25 by the pilot valve stem 36, and the closing of the injection openings 4 by the injection valve element 10.

The valve element 22 can be manufactured comparatively easily and thus correspondingly cost-effectively.

In all the exemplary embodiments shown, the high pressure inlet 8 is connected to a space in the housing which is coaxial with the longitudinal axis 2*a* of the housing and which forms the high pressure chamber 9 which is connected to the valve seat 16. However, the solution according to the invention can also be applied in fuel injection valves with a different configuration, in which the space in the housing which is connected to the high pressure inlet 8, forms the high pressure chamber and runs around the valve seat element 3 and extends parallel to but laterally offset from the longitudinal axis 2*a* of the housing, as is shown, for example, in EP-B-O 686 763.

What is claimed is:

1. A fuel injection valve for intermittent fuel injection into a combustion chamber of an internal combustion engine, comprising an elongate tubular housing (2) defining upper and lower ends and having a valve seat (16) mounted at the lower end and which includes at least one injection opening formed therein, and with said housing including a high pressure inlet (8) which opens to a high pressure chamber (9) within the housing, an injection valve member (10) mounted for axial movement within the housing between a lowered position closing the one injection opening and a raised position wherein the one injection opening is open and communicates with the high pressure chamber in the housing, said injection valve member including a control piston (18) formed at the end thereof opposite the valve seat, with the control piston having an upper end face which defines a lower side of a control chamber (20) within the housing, a closing spring (17) for biasing the injection valve element toward its lowered position, a control element (22) mounted within the housing adjacent the upper end thereof, with said control element having a control passage (25) which extends axially therethrough from an upper end side to its opposite lower end side, and with the opposite lower end side communicating with the control chamber, a pilot valve (5) for the controlled closing and opening of the control passage at the upper end side of the control element, an adjustable valve element (21, 41, 46) mounted adjacent the lower end side of the control element and which, in a closed position, bears against the lower end side of the control element, with said adjustable valve element including a throttle passage (26, 42, 47) through which the control chamber communicates with the control passage of the control element, and a throttle inlet (33) connected between the high pressure chamber in the housing and the control chamber, with the outlet of the throttle inlet being positioned so as to communicate with the control chamber without passing through an intermediate throttle point.

2. The fuel injection valve of claim 1, wherein the control piston is configured so that the high pressure of the fuel which is present in the high pressure chamber can be applied to the control piston on a surface thereof facing the valve seat.

3. The fuel injection valve of claim 1, wherein the smallest cross section of the throttle inlet is smaller than the smallest cross section of the control passage in the control element.

4. The fuel injection valve of claim 1, wherein the control passage in the control element has a throttle constriction.

5. The fuel injection valve of claim 1, wherein the throttle passage in the adjustable valve element has a throttle constriction which forms a throttle point.

6. The fuel injection valve of claim 1, wherein the throttle inlet opens directly into the control chamber.

7. The fuel injection valve of claim 1, wherein the throttle inlet opens into the throttle passage in the valve element at a location between a throttle constriction in the throttle passage and the control chamber.

8. The fuel injection valve of claim 7, wherein the throttle constriction is arranged at that end of the valve element which is adjacent the lower end side of the control element, and the throttle inlet is formed in the valve element and opens into the throttle passage between the throttle constriction and that end of the throttle passage which is adjacent the control chamber.

9. The fuel injection valve of claim 1, wherein the control piston and the valve element are arranged in the interior of a sleeve which laterally bounds the control chamber and which bears, at one of its ends, against the lower end side of the control element.

10. The fuel injection valve of claim 9, wherein the throttle inlet is formed in the sleeve.

11. The fuel injection valve of claim 1, wherein the adjustable valve element is guided in an axially sliding fit and which has a first end side which faces the control chamber and a second end side which faces opposite the first end side and with which the valve element bears, in its closed position, against the lower end side of the control element which is fixed to the housing, and with the throttle passage extending between the end sides of the valve element.

12. The fuel injection valve of claim 11, wherein the throttle passage is laterally offset with respect to the control passage in the control element, and when the valve element is in its closed position said throttle passage is connected to the control passage via a channel which is formed between the control element and the valve element.

13. The fuel injection valve of claim 12, wherein the channel is formed by a depression which is provided in the second end side of the valve element.

14. The fuel injection valve of claim 11, wherein the valve element has a further throttle passage (28) which extends between the first and second end sides of the valve element and which opens into the control chamber at the first end side of the valve element and which is closed by the control element at the second end side of the valve element when the valve element is in the closed position.

15. The fuel injection valve of claim 11, wherein the surface of the second end side of the valve element is smaller than the surface of the first end side of the valve element.

16. The fuel injection valve of claim 15, wherein the valve element has, at its end facing the control element, a cylindrical end part on which the second end side is formed and whose external diameter is smaller than the external diameter of the remainder of the valve element.

17. The fuel injection valve of claim 1, wherein the control element is fixed in the housing and wherein a bore (40; 45) which communicates with the high pressure chamber is formed in the control element, with said bore having a mouth which lies in the lower end side of the control element and which is closed by the valve element (41; 46) in the closed position of the valve element.

18. The fuel injection valve of claim 17, wherein the valve element is embodied as a spring-elastic tongue (41) which is attached in one region to the control element and in which the throttle passage is formed, and wherein the throttle passage is aligned with the control passage in the control element and forms a throttle point.

19. The fuel injection valve of claim 18 further comprising a sleeve which is positioned within the tubular housing, with the sleeve slideably receiving the control piston of the injection valve member and forming the lateral periphery of the control chamber, and wherein the throttle inlet extends through said sleeve and so as to form a direct connection between the high pressure chamber and the control chamber.

20. The fuel injection valve of claim 1, wherein the control element is fixed in the housing and a plurality of bores (45) which communicate with the high pressure chamber are formed in the control element, with the bores having mouths which lie in the lower end side of the control element and which are closed by the valve element in the closed position of the valve element.

21. The fuel injection valve of claim 20, wherein the valve element is embodied as a plate which is biased against the lower end side of the control element, and wherein the throttle passage which is formed in the valve element forms a throttle point which is aligned with the control passage in the control element.

22. The fuel injection valve of claim 21 wherein the valve element is biased against the lower end side of the control element by means of a compression spring which extends between the control piston and the valve element, and wherein the valve element may be axially separated from the valve element against the force of the compression spring to open the bores into communication with the control chamber.

23. The fuel injection valve of claim 22, wherein said compression spring has a biasing force which is smaller than the biasing force of said closing spring.

24. The fuel injection valve of claim 23 further comprising a sleeve which is positioned within the tubular housing, with the sleeve slideably receiving the control piston of the injection valve member and forming the lateral periphery of the control chamber, and wherein the throttle inlet extends through said sleeve and so as to form a direct connection between the high pressure chamber and the control chamber.

* * * * *